United States Patent [19]

Shafer

[11] 4,235,155

[45] Nov. 25, 1980

[54] DELAYING CONTROL FOR HYDRAULIC MOTORS

[76] Inventor: Homer J. Shafer, 2300 Park Ave. West, Mansfield, Ohio 44906

[21] Appl. No.: 14

[22] Filed: Jan. 2, 1979

[51] Int. Cl.[3] ..... F15B 13/16

[52] U.S. Cl. ..... 91/361; 91/426; 91/461; 91/465

[58] Field of Search ..... 91/219, 275, 305, 306, 91/323, 361, 465, 426

[56] References Cited

U.S. PATENT DOCUMENTS

| | | | |
|---|---|---|---|
| 3,301,137 | 1/1967 | D'Alba et al. | 91/219 |
| 3,334,547 | 8/1967 | Grundmonn | 91/219 |
| 3,365,624 | 1/1968 | Komendera | 91/219 |
| 3,540,348 | 11/1970 | Pennther | 91/306 |

FOREIGN PATENT DOCUMENTS

| | | | |
|---|---|---|---|
| 2654219 | 6/1978 | Fed. Rep. of Germany | 91/275 |

*Primary Examiner*—Paul E. Maslousky
*Attorney, Agent, or Firm*—Hamilton, Renner & Kenner

[57] ABSTRACT

A delaying device for a fluid system for operating a hydraulic motor (10) wherein electrically operated pilot valves (39,40) are actuated by limit switches (13,13') in the motor to control flow through pilot lines (37,38) into a control block (20) and then to and from the motor, said delaying device comprising a dashpot cylinder (46) connected to said pilot lines for momentarily continuing to supply fluid to said control block (20) after pilot valve (39 or 40) is shut off.

8 Claims, 1 Drawing Figure

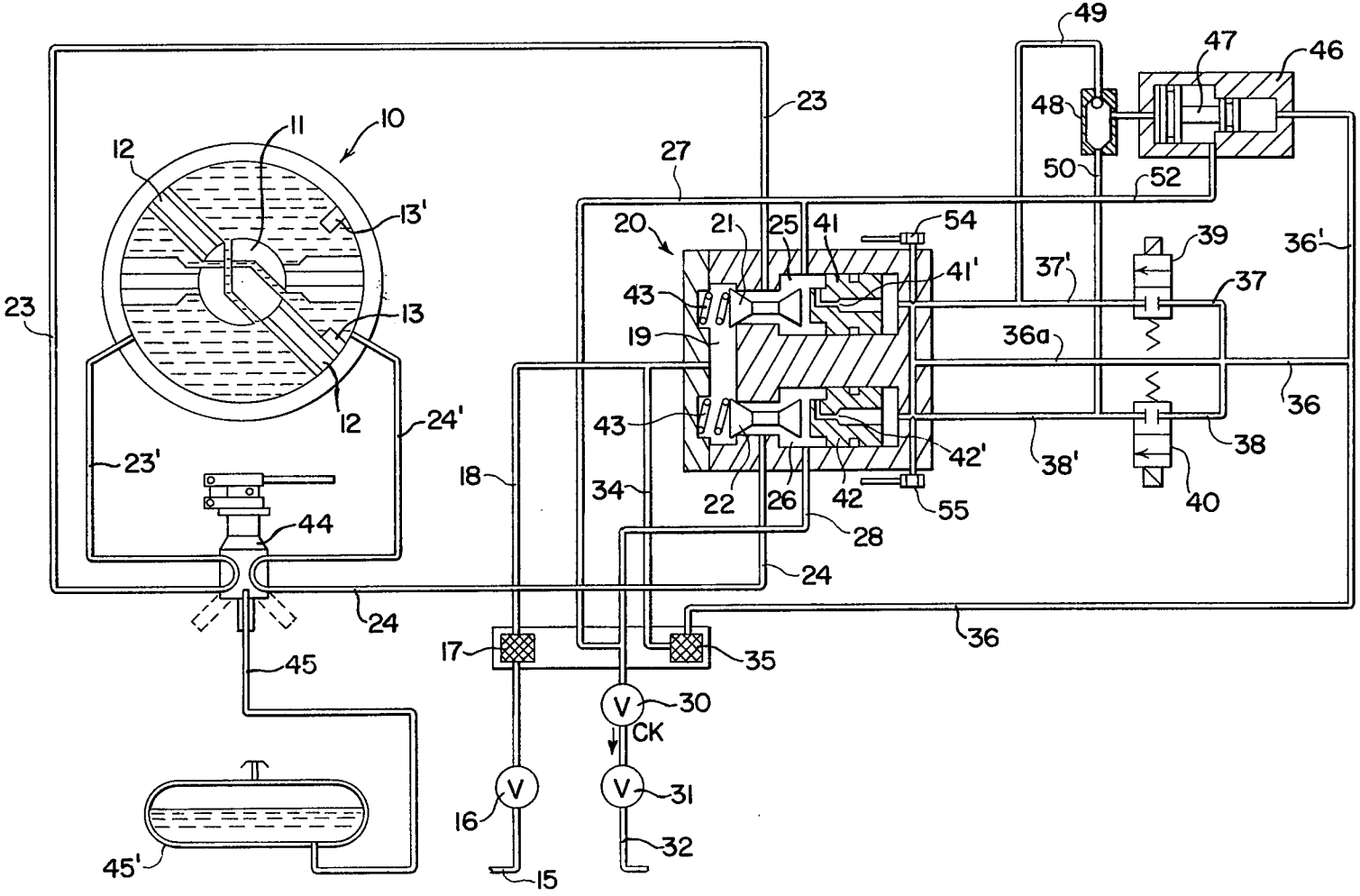
46
47
49
48
50
52
36'
36
37
38
39
40
37'
36a
38'
54
41'
42'
55
41
42
28
23
25
26
24
21
22
35
27
20
43
19
43
34
30
CK
31
32
15
18
17
16
24'
10
13'
13
12
11
44
45
24
12
23'
45'
23

DELAYING CONTROL FOR HYDRAULIC MOTORS

TECHNICAL FIELD

The invention relates to hydraulic systems for piston operators for opening and closing valves in a fluid transmitting pipeline, and particularly for rotary piston operators for rotary valves.

BACKGROUND ART

Hydraulic motors are commonly used as operators for valves in pipeline systems transporting fluids such as oil or gas. For rotary valves the hydraulic motor has a vaned rotor keyed to the valve stem and rotating through an arc of about 90° to rotate the valve element between open and closed positions. Stops are provided in the valve to stop the element accurately at fully open and fully closed positions, and stops in the motor to limit the travel of the vanes must be located accurately to correspond to the stops in the valve.

It is often desirable, particularly in power oil systems, to use solenoid or other electrically operated valves to control the flow of fluid to and from the motor, and limit switches for actuating the solenoid valves are installed in the hydraulic motor to contact the rotor vanes at the end of the valve opening and closing stroke. These switches, particularly the magnetic type usually used, are inaccurate in timing, with the result that it is very difficult to position the switches so as to actuate the solenoid valves at the exact instant required to stop the vanes and the valve element at the fully closed or fully open position. If there is undertravel of the vanes the valve element may not be fully closed or fully open, and if there is overtravel of the vanes, the stops in the valve are subjected to excessive impact and wear.

DISCLOSURE OF THE INVENTION

The present invention provides a delaying device which cooperates with the solenoid controls to insure that the valve operator can move the valve element to fully closed or fully open position after the solenoid controls are actuated, thus compensating for inaccuracy of operation of the limit switches actuating the solenoid controls.

An object of the invention is to provide a hydraulic delay cylinder connected to the solenoid-controlled fluid lines operating the valve operator motor, said cylinder adapted to supply fluid to the lines for a short period after the solenoid valves are shut off.

A further object is to provide a hydraulic delay cylinder in which the piston is maintained in neutral position by connection with the power oil used to operate the valve operator motor.

Another object is to provide a hydraulic delay cylinder having a differential piston for supplying fluid to the control lines for a short period after the solenoid valves are shut off and for then returning the piston to neutral position.

BRIEF DESCRIPTION OF DRAWINGS

The FIGURE is a schematic view of a hydraulic system for operating a rotary vane hydraulic motor controlling a pipeline valve, utilizing solenoid valve controls and embodying the improved delaying control.

PREFERRED EMBODIMENT FOR CARRYING OUT THE INVENTION

In the drawing, the rotary hydraulic motor is indicated generally at 10, having a rotor 11 which is operatively mounted on the valve stem of a rotary valve (not shown) in a pipeline. The rotor 11 has diametrically opposite vanes 12 which are rotated through about 90° by hydraulic pressure fluid applied to one side of the vanes and exhausted from the opposite sides in a usual and wellknown manner. The rotation in either direction is limited by contact with switches in the motor housing, which are indicated schematically at 13 and 13'.

The fluid for operating the hydraulic motor may be oil under pressure supplied from a suitable source to the incoming line 15 and through valve 16. From the valve 16 the oil is conducted through a strainer 17 and line 18 to the pressure chamber 19 of a control block indicated generally at 20.

The control block 20 has a pair of double-headed poppet valves 21 and 22 for connecting the pressure chamber alternatively with the two conduit lines 23 and 24, respectively, leading to opposite sides of the hydraulic motor. The lines 23 and 24 are normally connected to exhaust chambers 25 and 26, respectively, from which lines 27 and 28, respectively, are connected through check valve 30 and valve 31 to a return oil line 32. Check valve 30 permits flow from lines 27 and 28 to line 32 and prevents flow in the reverse direction.

A pilot line 34 leads from line 18 through a strainer 35 and line 36 to pilot lines 37 and 38 through two-way valves 39 and 40 and lines 37' and 38' into the control block to operate the poppet valves 21 and 22. The control valves 39 and 40 are preferably solenoid operated but may be other suitable types of electrically operated control valves. The poppet valves are operated by pistons 41 and 42, respectively, movable alternatively in exhaust chambers 25 and 26 to open the poppet valves against the pressure of back-up springs 43. Pistons 41 and 42 have bleed ports 41' and 42' therethrough for a purpose to be described.

Assuming that the main pipeline valve to be operated is in open position when the rotor 11 is in the position shown in the drawings, if solenoid valve 40 is energized to open, the power oil from pilot line 38 will move piston 42 against poppet valve 22 and connect pressure chamber 19 with line 24 while shutting off the exhaust chamber 26 from line 24. Chamber 26 remains in connection with exhaust line 28.

The power oil from line 24 normally by-passes through a standby hand pump 44 (connected by line 45 to an oil reservoir 45') and then connects through line 24' with one side of the motor 10, turning the rotor 11 clockwise to close the main pipeline valve. When the rotor has turned through about 90° the vanes 12 abut the switch 13' to stop the rotor at the point where the pipeline valve is calculated to be fully closed with the valve element in abutment with the stops in the valve body.

As the rotor turns clockwise oil is exhausted through line 23' by-passing pump 44 and flows through line 23 to exhaust chamber 25 and thence through exhaust line 27. To open the pipeline valve solenoid valve 39 is energized to open poppet valve 21 and connect pressure chamber 19 with line 23 while shutting off exhaust chamber from line 23 and flow through the motor is reversed, the exhaust oil flowing through lines 24' and 24 to exhaust chamber 26 and thence through exhaust line 28.

It is very difficult to position the switches 13 and 13' in the motor 10 at the precise locations for matching the stops in the body of the main pipeline valve, particularly because the solenoid valves cut off flow instantaneously, with the result that the valve element in the main pipeline valve may underrun or overrun the stops in the valve body, leaving the valve cracked slightly open or subjecting the valve stops to excessive impact and wear.

The present invention provides a momentary delay after the solenoid valve is energized to allow the oil flow to continue long enough to compensate for inaccurate location of the limit switches in the hydraulic operator motor and insure that the valve element in the pipeline valve is in proper abutment with the stops in the valve body.

This momentary delay is accomplished by connecting pilot line 36 through line 36' to the small end of a dash pot cylinder 46, in which a double-ended piston 47 having different areas is movable. The large end of the cylinder 46 is connected to the medial part of a shuttle valve 48, the ends of which are connected by lines 49 and 50 to the pilot lines 37' and 38', respectively.

Now, when either solenoid valve 39 or 40 is opened, oil passes through the respective line 49 or 50 to move the piston 47 to the right due to the larger area at the left end and fills the large end of the cylinder 46. When the solenoid valve is closed by action of the limit switch in the motor, the oil in the large end of the cylinder is forced out by the constant pressure on the small end of the piston 47 and holds the piston 41 or 42, which was previously moved to actuate the corresponding poppet valve 21 or 22, in actuating position for one to three seconds as determined by the time required for oil to bleed through the bleed port 41' or 42' in the actuating piston into the corresponding exhaust chamber 25 or 26. When all of the oil in the large part of the dashpot cylinder 46 has been expelled, the poppet valve closes and shuts off oil flow to and from the hydraulic motor 10. The dashpot cylinder 46 is connected between the ends of piston 47 by a bleed line 52 to exhaust chamber 25 in the control block.

It is desirable to provide for manual operation of the control block 20 without energizing the solenoid valves 39 and 40, as these valves are normally not accessible to manual operation. For the purpose of manual operation, by-pass needle valves 54 and 55 are mounted in block 20 for making connection between a central pilot line **36*a* leading from pilot line 36 into the block selectively with pistons 41 and 42**.

The needle valves normally are projected into the block to close off flow from line **36*a* but are constructed to by-pass flow from lines 37' and 38' into the block when the solenoid valves are energized. To operate manually when both solenoid valves are closed, one or the other of the by-pass valves 54 or 55 is partially withdrawn. Thus, if it is desired to actuate piston 42, valve 55 is partially withdrawn to connect pilot line 36*a* with the chamber housing piston 42, thereby opening poppet valve 22 to connect pressure chamber 19 with conduit line 24 leading to the hydraulic motor 10**.

It should be apparent that the present invention mechanism cooperates with the electrically operated control valves in the oil system for operating the hydraulic operator motor to provide a momentary delay after the solenoid valve is closed, thereby compensating for inaccuracy in timing and insuring that the motor moves the pipeline valve element to precise open or closed position. The improved mechanism utilizes the power oil which operates the motor, and manually operable valves are provided for by-passing the electrically operated control valves.

INDUSTRIAL APPLICABILITY

The invention is useful in operating a rotary piston hydraulic motor through a pressure fluid system where precise locations of stopping the rotary piston are required.

I claim:

1. In a fluid system for operating a fluid piston hydraulic motor, a power fluid supply, control means for supplying power fluid to said motor and exhausting it therefrom, and electrically operated pilot valve means for operably connecting said power fluid supply through pilot lines to said control means, said pilot valve means operated by limit switches in said motor to control the stopping position of said piston in either direction, the improvement comprising means for momentarily delaying shutting off the control means after actuation of the pilot valve means, said delaying means comprising a dashpot cylinder connected to said pilot lines for momentarily continuing to supply power fluid to said control means after said pilot valve means is moved to a closed position disconnecting the fluid supply from the control means.

2. In a fluid system as defined in claim 1, wherein said dashpot cylinder has a double-ended piston of different areas subjected to power fluid pressure for momentarily supplying power fluid to said control means after said pilot valve means is moved to said closed position.

3. In a fluid system as defined in claim 2, wherein said control means has actuating pistons with bleed ports therethrough which regulate the time delay after the pilot means is moved to said closed position.

4. In a fluid system as defined in claim 1, wherein said control means has actuating pistons with bleed ports therethrough which regulate the time delay after the pilot means is moved to said closed position.

5. In a fluid system as defined in claim 4, wherein by-pass valves are provided to connect the pilot lines to the actuating pistons when the pilot valve means are moved to said closed position for manually operating the hydraulic motor.

6. In a fluid system as defined in claim 1, wherein by-pass valves are provided to connect the pilot lines to the control means when the pilot valve means are moved to said closed position for manually operating the hydraulic motor.

7. In a fluid system for operating a fluid piston hydraulic motor, a power fluid supply, control means for supplying power fluid to said motor and exhausting it therefrom, and electrically operated pilot valve means for operably connecting said power fluid supply through pilot lines to said control means, said pilot valve means operated by limit switches in said motor to control the stopping positions of said piston in either direction, the improvement comprising means for momentarily delaying shutting off the control means after actuation of the pilot valve means, said delaying means comprising a dashpot cylinder having therein a double-ended piston of different areas, the smaller area constantly subjected to direct pilot line pressure and the larger end subjected selectively to pressure from a pilot line connected to the control means by the electrically operated pilot valve means, whereby power fluid actuated by said larger end momentarily continues to supply power fluid to said control means after said pilot valve means is moved to a closed position disconnecting the fluid supply from the control means.

8. In a fluid system as defined in claim 7, wherein said control means has actuating pistons with bleed ports therethrough which regulate the time delay after the pilot valve means is moved said to closed position.

* * * * *